US010941772B2

(12) United States Patent
Schaefer et al.

(10) Patent No.: US 10,941,772 B2
(45) Date of Patent: Mar. 9, 2021

(54) SUCTION LINE ARRANGEMENT FOR MULTIPLE COMPRESSOR SYSTEM

(71) Applicant: Emerson Climate Technologies, Inc., Sidney, OH (US)

(72) Inventors: James A. Schaefer, Troy, OH (US); Harry B. Clendenin, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 106 days.

(21) Appl. No.: 15/445,137

(22) Filed: Feb. 28, 2017

(65) Prior Publication Data

US 2017/0268513 A1 Sep. 21, 2017

Related U.S. Application Data

(60) Provisional application No. 62/308,245, filed on Mar. 15, 2016.

(51) Int. Cl.
*F03C 2/00* (2006.01)
*F03C 4/00* (2006.01)
(Continued)

(52) U.S. Cl.
CPC ..... *F04C 27/008* (2013.01); *F04B 39/0284* (2013.01); *F04B 39/121* (2013.01);
(Continued)

(58) Field of Classification Search
CPC .. F04B 39/0284; F04B 39/121; F04B 39/123; F04B 41/06; F04C 18/0215;
(Continued)

(56) References Cited

U.S. PATENT DOCUMENTS 4,179,248 A 12/1979 Shaw
4,979,885 A * 12/1990 Yasuda ..... F04C 29/00 418/270
(Continued)

FOREIGN PATENT DOCUMENTS

CN 1333450 A 1/2002
CN 203161535 U 8/2013
(Continued)

OTHER PUBLICATIONS

JP5876862U—No name—No Title—May 24, 1983—English Translation (Year: 1983).*
(Continued)

*Primary Examiner* — Theresa Trieu
(74) *Attorney, Agent, or Firm* — Hamess, Dickey & Pierce, P.L.C.

(57) ABSTRACT

A compressor includes a shell assembly and a compression mechanism disposed within the shell assembly. The shell assembly includes first and second end caps. A suction chamber is disposed within the shell assembly between the first end cap and the second end cap. A discharge chamber and oil sump may be disposed within the shell assembly. The shell assembly includes at least one suction opening into the suction chamber. A distributor is in communication with one of the suction openings. Plugs may sealingly engage another one of the suction openings. The distributor includes an inlet path and first and second outlet paths. A suction line is coupled to the inlet path. The suction line includes at least first and second portions. A first plane bisecting the second portion along a length of the second portion is perpendicular to a second plane that bisects the first and second outlet paths.

22 Claims, 10 Drawing Sheets

(51) Int. Cl.

| | |
|---|---|
| ***F04C 18/00*** | (2006.01) |
| ***F04C 2/00*** | (2006.01) |
| ***F04C 27/00*** | (2006.01) |
| ***F04C 23/00*** | (2006.01) |
| ***F04B 39/12*** | (2006.01) |
| ***F04B 41/06*** | (2006.01) |
| ***F04B 39/02*** | (2006.01) |
| ***F04C 18/02*** | (2006.01) |
| ***F04C 29/02*** | (2006.01) |
| ***F04C 29/12*** | (2006.01) |

(52) U.S. Cl.
CPC ..... *F04B 39/123* (2013.01); *F04B 41/06* (2013.01); *F04C 18/0215* (2013.01); *F04C 23/001* (2013.01); *F04C 23/003* (2013.01); *F04C 23/008* (2013.01); *F04C 29/02* (2013.01); *F04C 29/12* (2013.01); *F04C 2240/70* (2013.01); *F04C 2240/806* (2013.01)

(58) Field of Classification Search
CPC .... F04C 23/001; F04C 23/003; F04C 23/008; F04C 27/008; F04C 29/02; F04C 29/12; F04C 2240/70; F04C 2240/806
USPC ..... 418/55.1–55.6, 57, 5, 7, 88, 94, 270
See application file for complete search history.

(56) References Cited

U.S. PATENT DOCUMENTS

| | | | | |
|---|---|---|---|---|
| 5,385,453 | A | 1/1995 | Fogt et al. | |
| 5,584,949 | A * | 12/1996 | Ingram | B60C 23/003 152/417 |
| 5,988,223 | A | 11/1999 | Kanzaki et al. | |
| 6,213,731 | B1 | 4/2001 | Doepker et al. | |
| 6,273,427 | B1 * | 8/2001 | Simmons | F25B 41/003 138/89 |
| 6,679,072 | B2 | 1/2004 | Pham et al. | |
| 8,459,053 | B2 | 6/2013 | Pham et al. | |
| 8,485,789 | B2 | 7/2013 | Gu et al. | |
| 8,585,382 | B2 | 11/2013 | Akei et al. | |
| 8,616,014 | B2 | 12/2013 | Stover et al. | |
| 9,551,351 | B2 | 1/2017 | De Bernardi et al. | |
| 2005/0244286 | A1 * | 11/2005 | Palma | F04C 29/00 417/410.4 |
| 2010/0186433 | A1 | 7/2010 | Galante et al. | |
| 2011/0138831 | A1 | 6/2011 | Ogata et al. | |
| 2013/0255309 | A1 | 10/2013 | Wu et al. | |
| 2013/0298594 | A1 | 11/2013 | Bonnefoi et al. | |
| 2014/0037484 | A1 | 2/2014 | Fraser et al. | |
| 2014/0241926 | A1 | 8/2014 | Fraser | |

FOREIGN PATENT DOCUMENTS

| | | | | |
|---|---|---|---|---|
| JP | 5876862 U | * | 5/1983 | F16J 13/14 |
| JP | 62038888 A | * | 2/1987 | F04C 15/06 |
| JP | 2005076515 A | | 3/2005 | |

OTHER PUBLICATIONS

JPS6238888A—Asano et al.—Scroll Type Compressor—Feb. 19, 1987—Machine Translation with English language. (Year: 1987).*
Search Report regarding European Patent Application No. 17160627.0, dated Aug. 9, 2017.
Office Action regarding Chinese Patent Application No. 201710150253.0, dated Aug. 10, 2018. Translation provided by Unitalen Attorneys at Law.
U.S. Appl. No. 16/387,694, filed Apr. 18, 2019, Prashant Rangnath Raskar et al.

* cited by examiner

SUCTION LINE ARRANGEMENT FOR MULTIPLE COMPRESSOR SYSTEM

CROSS-REFERENCE TO RELATED APPLICATIONS

This application claims the benefit of U.S. Provisional Application No. 62/308,245, filed on Mar. 15, 2016. The entire disclosure of the above application is incorporated herein by reference.

FIELD

The present disclosure relates to a multiple compressor system, and more particularly, to a suction line arrangement for balancing working fluids between the compressors of the multiple compressor system.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that includes a shell assembly and a compression mechanism disposed within the shell assembly. The shell assembly has a first end cap, a cylindrical portion, and a second end cap. The first end cap forms a discharge chamber. The shell assembly has at least one discharge opening into the discharge chamber. A suction chamber is disposed within the shell assembly between the discharge chamber and the second end cap and is enclosed by the cylindrical portion. The shell assembly has at least two suction openings into the suction chamber.

In some embodiments, a first plug may seal one of the suction openings and prevent fluid flow therethrough.

In some embodiments, an oil sump may be disposed within the shell assembly above the second end cap. The shell assembly may have a plurality of oil openings into the oil sump, and one of the oil openings may be sealed with a second plug, which prevents fluid flow therethrough.

In some embodiments, the second plug may include an oil sight glass.

In some embodiments, a third plug may seal one of the discharge openings and prevent fluid flow therethrough.

In some embodiments, a discharge line may be coupled with another one of the discharge openings, a suction tube may be coupled with another one of the suction openings, and an oil equalization line may be coupled with another one of the oil openings.

In another form, the present disclosure provides a system that includes a first compressor and a second compressor. Each compressor includes a compression mechanism disposed within a shell assembly. The shell assembly defines a discharge chamber containing discharge-pressure working fluid discharged from the compression mechanism. The shell assembly defines a suction-pressure region containing suction-pressure working fluids. The shell assembly has a plurality of suction openings that are in communication with the suction-pressure region. The shell assembly has at least one discharge opening that is in communication with the discharge chamber.

In some embodiments, a suction line may be in communication with one of the suction openings of the first compressor and one of the suction openings of the second compressor. A first plug may seal another one of the suction openings of the first compressor and prevent fluid flow therethrough. In some embodiments, a second plug may seal another one of the suction openings of the second compressor and prevent fluid flow therethrough.

In some embodiments, a discharge line may be in communication with one of the discharge openings of the first compressor and one of the discharge openings of the second compressor. A first plug may seal another one of the discharge openings of the first compressor and prevent fluid flow therethrough. In some embodiments, a second plug may seal another one of the discharge openings of the second compressor and prevent fluid flow therethrough.

In some embodiments, the shell assembly may define an oil sump and include a plurality of oil openings in communication with the oil sump. An oil equalization line may be in communication with one of the oil openings of the first compressor and one of the oil openings of the second compressor. A first plug may seal another one of the oil openings of the first compressor and prevent fluid flow therethrough. A second plug may seal another one of the oil openings of the second compressor and prevent fluid flow therethrough.

In some embodiments, one or both of the first plug and the second plug preventing fluid flow through one of the oil openings of the first compressor and one of the oil openings of the second compressor, respectively, may include an oil sight glass.

In some embodiments, a distributor may have an inlet path and first and second outlet paths. The first outlet path may be coupled to a first suction tube. The first suction tube may be in communication with one of the suction openings of the first compressor. Another one of the suction openings of the first compressor may be sealed to prevent fluid flow therethrough. The second outlet path may be coupled to a second suction tube. The second suction tube may be in communication with one of the suction openings of the second compressor. Another one of the suction openings of the second compressor may be sealed to prevent fluid flow therethrough.

In some embodiments, a distributor may include an inlet path and first and second outlet paths. The first outlet path may be in communication with one of the suction openings of the first compressor. The second outlet path may be in communication with one of the suction openings of the second compressor.

In some embodiments, a suction line may be coupled to the inlet path of the distributor. The suction line may include a first linear portion and a second linear portion connected by a curved third portion. The curved third portion is orientated perpendicularly to the outlet paths of the distributor.

In some embodiments, a straight suction line may be coupled to the inlet path of the distributor. The straight suction line is of a predetermined length so to allow fluids to obtain even flow prior to reaching the distributor.

In some embodiments, a discharge line may be in communication with the discharge openings of the first compressor and one of the discharge openings of the second compressor. A first plug may seal another one of the discharge openings of the first compressor and prevent fluid flow therethrough. In some embodiments, a second plug may seal another one of the discharge openings of the second compressor and prevent fluid flow therethrough.

In some embodiments, the shell assembly may define an oil sump and include a plurality of oil openings in communication with the oil sump. An oil equalization line may be in communication with one of the oil openings of the first compressor and one of the oil openings of the second compressor. A first plug may seal another one of the oil openings of the first compressor and prevent fluid flow therethrough. A second plug may seal another one of the oil openings of the second compressor and prevent fluid flow therethrough.

In some embodiments, one or both of the first plug and the second plug that seal the another one of oil openings of the first compressor and the another one of the oil openings of the second compressor, respectively, may include an oil sight glass.

In another form, the present disclosure provides a compressor that includes a shell assembly and a compression mechanism disposed within the shell assembly. The shell assembly may have a first end cap, a cylindrical portion, and a second end cap. The first end cap may form a discharge chamber. The shell assembly may have at least one discharge opening into the discharge chamber. An oil sump may be disposed within the shell assembly above the second end cap. The shell assembly may have at least two oil openings into the oil sump.

In some embodiments, a discharge line may be in communication with one of the discharge openings, and a plug may seal another one of the discharge openings and prevent fluid flow therethrough.

In some embodiments, an oil equalization line may be in communication with one of the oil openings, and a plug may seal another one of the oil openings and prevent fluid flow therethrough.

In some embodiments, the plug that seals the another one of the oil openings includes an oil sight glass.

In another form, the present disclosure provides a system that includes a first compressor and a second compressor. The first compressor and second compressor both include a compression mechanism disposed within a shell assembly. The shell assembly defines a discharge chamber and a suction-pressure region. The discharge chamber contains discharge-pressure working fluid discharged from the compression mechanism. The suction-pressure region contains suction-pressure working fluid. Each shell assembly has a suction opening in communication with the suction-pressure region and a discharge opening in communication with the discharge chamber. A distributor is in communication with the shell assembly. The distributor has an inlet path and first and second outlet paths. The first outlet path of the distributor is in communication with the suction opening of the first compressor. The second outlet path of the distributor is in communication with the suction opening of the second compressor. A suction line is coupled to the inlet path of the distributor. The suction line includes a first portion and a second portion. The first portion is disposed upstream of the inlet path of the distributor and downstream of the second portion of the suction line. A first plane bisects the second portion along the length of the second portion. A second plane bisects the first and second outlet paths. The first plane is perpendicular to the second plane.

In some embodiments, the first portion of the suction line may be a linear portion and the second portion of the suction line may be a curved portion. The first portion connects the second portion to the distributor.

In some embodiments, the first portion of the suction line may be a first linear portion and the second portion of the suction line may be a second linear portion. The first portion forms a ninety-degree angle with the second portion.

In some embodiments, the shell assembly may include a plurality of suction openings in communication with the suction-pressure region, and the system may include first and second plugs. The first plug may seal one of the suction openings of the first compressor and prevent fluid flow therethrough. The second plug may seal one of the suction openings of the second compressor and prevent fluid flow therethrough.

In some embodiments, the shell assembly may include a plurality of discharge openings in communication with the discharge chamber, and the system may include a discharge line and a first plug. The discharge line may be in communication with one of the discharge openings of the first compressor and one of the discharge openings of the second compressor. The first plug may seal another one of the discharge openings of the first compressor and prevent fluid flow therethrough. In some embodiments, a second plug may seal another one of the discharge openings of the second compressor and prevent fluid flow therethrough.

In some embodiments, the shell assembly may define an oil sump and may include a plurality of oil openings that are in communication with the oil sump, and the system may include an oil equalization line, a first plug, and a second plug. The oil equalization line may be in communication with one of the oil openings of the first compressor and one of the oil openings of the second compressor. The first plug may seal another one of the oil openings of the first compressor and prevent fluid flow therethrough. The second plug may seal another one of the oil openings of the second compressor and prevent fluid flow therethrough.

In some embodiments, one or both of the first and second plugs that seal the another one of the oil openings of the first and second compressors, respectively, may include an oil sight glass.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
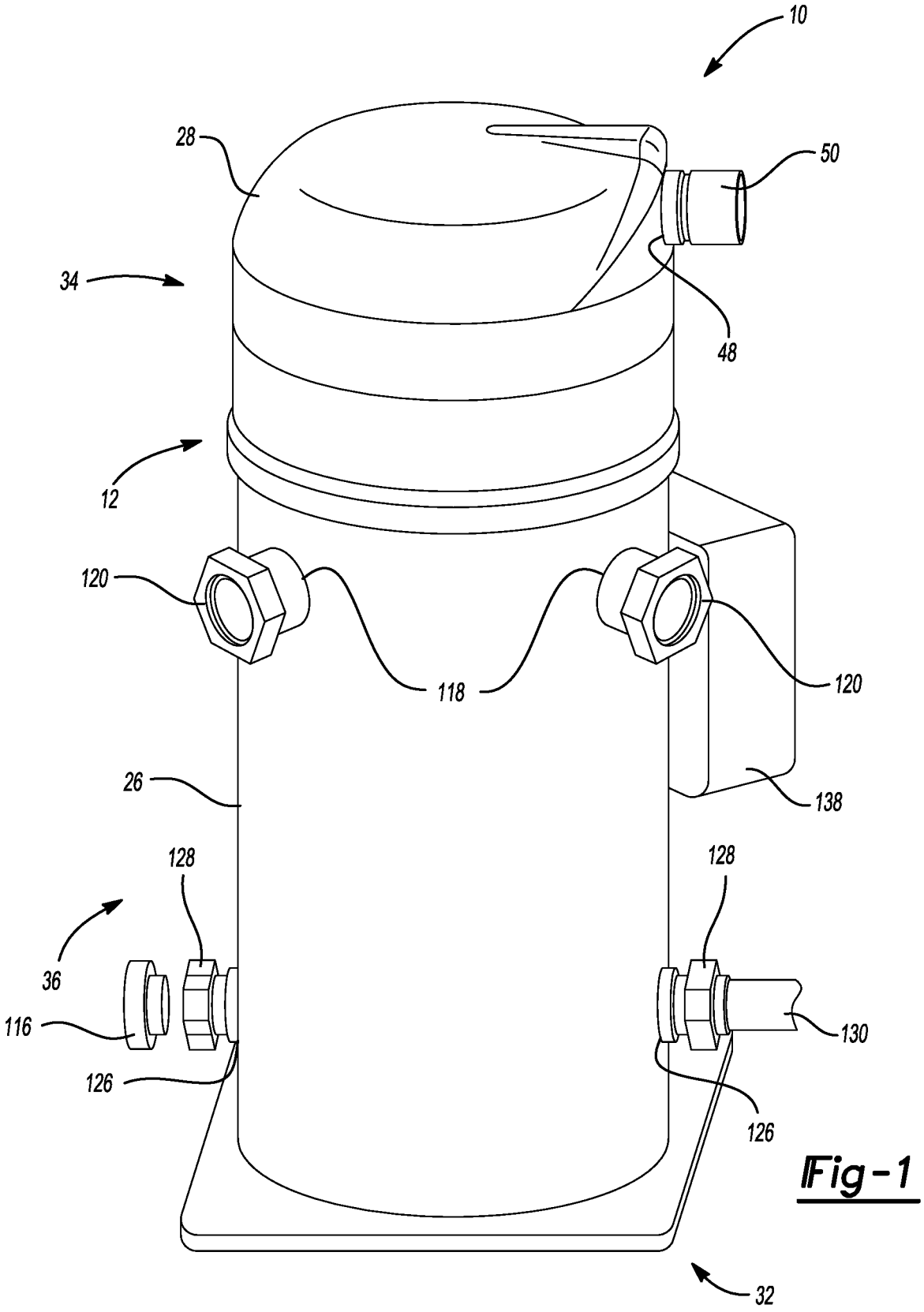
FIG. 1 is a perspective view of a single compressor in accordance with the principles of the present teachings.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
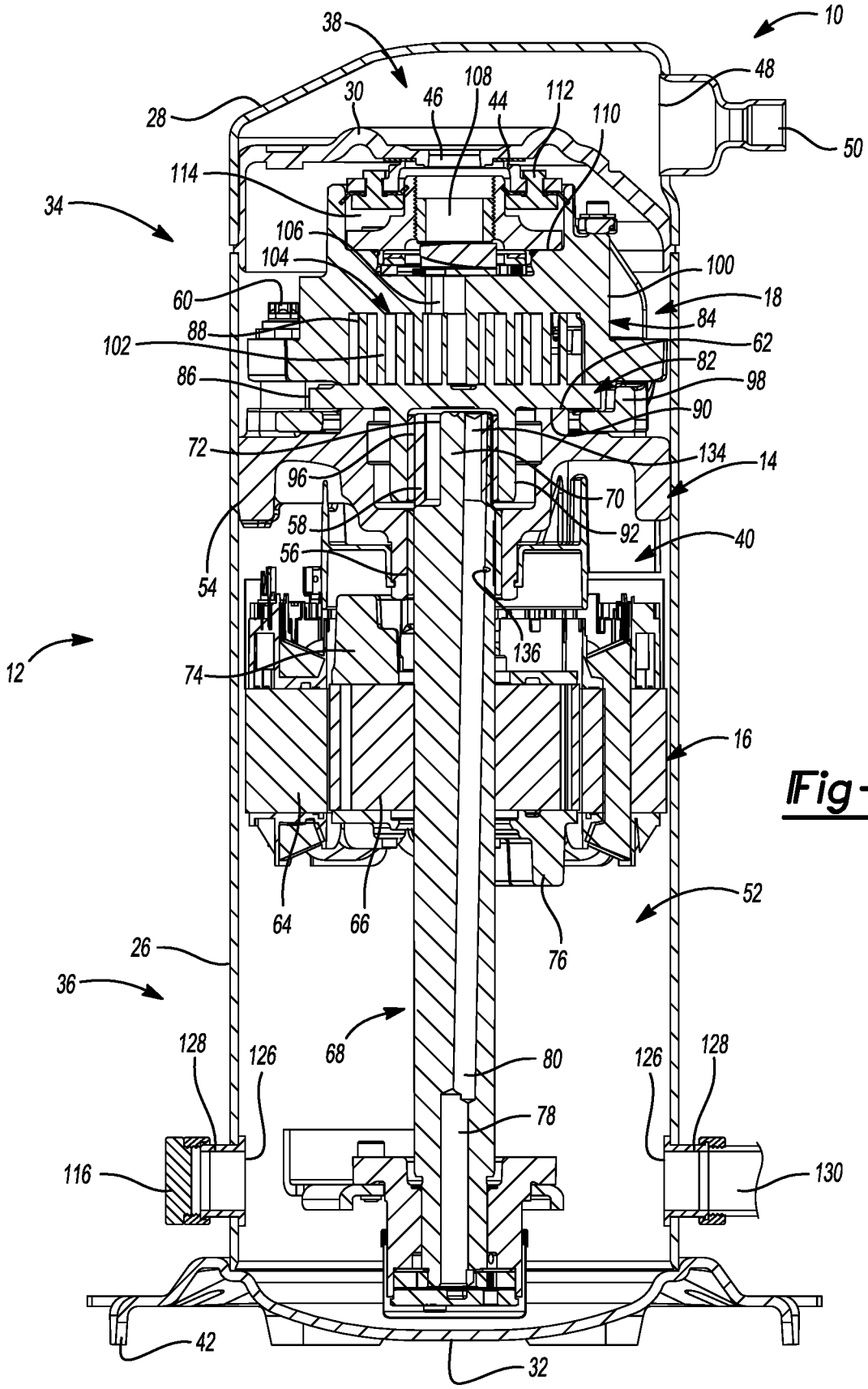
FIG. 2 is cross sectional view of a single illustrative compressor in accordance with the principles of the present teachings.

With reference to FIGS. 1 and 2, a single, illustrative compressor 10 is shown. While the compressor 10 is illustrated as a low-side compressor, the present disclosure applies equally to high-side compressors. The compressor 10 may include a shell assembly 12, a bearing housing assembly 14, a motor assembly 16, a compression mechanism 18, a discharge chamber 38, a suction chamber 40, and an oil sump 52. The shell assembly 12 may house the bearing housing assembly 14, the motor assembly 16, and the compression mechanism 18. The shell assembly 12 may house the discharge chamber 38, the suction chamber 40, and the oil sump 52.

The shell assembly 12 may generally form a compressor housing and may include a cylindrical portion 26, an end cap 28, a transversely extending partition 30, and a base 32. The cylindrical portion 26 may be suitably secured to the end cap 28, the transversely extending partition 30, and the base 32. The transversely extending partition 30 may be suitably secured to the cylindrical portion 26 at the same point at which the end cap 28 is suitably secured to the cylindrical portion 26. For example, the end cap 28 and the transversely extending partition 30 may be suitably secured to an upper portion 34 of the shell assembly 12. The base 32 may be suitably secured to a lower portion 36 of the shell assembly 12.

The end cap 28 and cylindrical portion 26 may generally form the upper portion 34 of the shell assembly 12. The transversely extending partition 30 and the end cap 28 may form a discharge chamber 38. The discharge chamber 38 may generally form a discharge muffler for the compressor 10. While the compressor 10 is illustrated as including the discharge chamber 38, the present disclosure applies equally to direct discharge configurations.

The end cap 28 may have at least one discharge opening 48 through the shell assembly 12 into the discharge chamber 38. A discharge fitting 50 may be coupled to the shell assembly 12 at the discharge opening 48. For example, compressed working fluid may move from within the discharge chamber 38 to outside of the shell assembly 12 through the discharge fitting 50 extending through the discharge opening 48.

The transversely extending partition 30 may separate the discharge chamber 38 from the compression mechanism 18. The transversely extending partition 30 may separate the discharge chamber 38 from a suction chamber 40. The transversely extending partition 30 may include a wear ring 44 and a discharge passage 46 extending therethrough to provide communication between the compression mechanism 18 and the discharge chamber 38.

The base 32 and the cylindrical portion 26 may generally form the lower portion 36 of the shell assembly 12. The compression mechanism 18, the suction chamber 40, and the oil sump 52 may be formed between the transversely extending partition 30 and the base 32. The base 32 may include a plurality of mounting feet 42.

The bearing housing assembly 14 may be affixed to the shell assembly 12 at a plurality of points in any desirable manner, such as staking. The bearing housing assembly 14 may generally include a main bearing housing 54, a plurality of bearings 56, a drive bushing 58, and a plurality of bolts 60 disposed therein. The main bearing housing 54 may house the plurality of bearings 56 therein and may define an annular flat thrust bearing surface 62 on an axial end surface thereof.

The motor assembly 16 may generally include a motor stator 64, a rotor 66, and a drive shaft 68. The motor stator 64 may be press fit into the shell assembly 12. The rotor 66 may be press fit on the drive shaft 68 and may include counterweights 74, 76.

The drive shaft 68 may be rotatably driven by the rotor 66 and may be rotatably supported within the plurality of bearings 56. The drive shaft 68 may include an eccentric crank pin 70 having a flat 72 thereon. The drive shaft 68 may also include an oil-pumping concentric bore 78 that communicates with a radially outwardly inclined and a relatively smaller diameter bore 80 extending to the upper end of drive shaft 68. The oil-pumping concentric bore 78 may provide a pump action in conjunction with the smaller diameter bore 80 to distribute lubricating fluid to various portions of the compressor 10. For example, the oil sump 52 may be filled with lubricating oils. The oil-pumping concentric bores 78 and the smaller diameter bore 80 may provide pump action to distribute the lubricating oils of the oil sump 52 to various portions of the compressor 10.

The compression mechanism 18 is supported by the bearing housing assembly 14, specifically the main bearing housing 54. The compression mechanism 18 is driven by the motor assembly 16 and generally includes an orbiting scroll member 82 and a non-orbiting scroll member 84.

The orbiting scroll member 82 may include an end plate 86 having a spiral vane or wrap 88 on the upper surface thereof and an annular flat thrust surface 90 on the lower surface. The annular flat thrust surface 90 may interface with the annular flat thrust bearing surface 62 on the main bearing housing 54. A cylindrical hub 92 may project downwardly from the annular flat thrust surface 90 and may include a journal bearing 96 having the drive bushing 58 rotatably disposed therein. The drive bushing 58 may include an inner bore in which the eccentric crank pin 70 is drivingly disposed. The flat 72 of the eccentric crank pin 70 drivingly engages a flat surface in a portion of the inner bore of the drive bushing 58 to provide a radially compliant driving arrangement. An Oldham coupling 98 may engage the main bearing housing 54, the orbiting scroll member 82, and the non-orbiting scroll members 84 to prevent relative rotation between the orbiting scroll member 82 and the non-orbiting scroll member 84.

The non-orbiting scroll member 84 may include an end plate 100 having a spiral wrap 102 on a lower surface thereof. The spiral wrap 102 forms a meshing engagement with the spiral wrap 88 of the orbiting scroll member 82, thereby creating a series of moving compression pockets 104. The non-orbiting scroll member 84 has a centrally disposed discharge passageway 106 in communication with one of the series of moving compression pockets 104. The non-orbiting scroll member 84 has an upwardly open recess 108 that may be in fluid communication with the discharge chamber 38 via the discharge passage 46 of the transversely extending partition 30. The plurality of bolts 60 may secure the non-orbiting scroll member 84 to the main bearing housing 54.

The non-orbiting scroll member 84 may include an annular recess 110 in the upper surface thereof having parallel coaxial side walls in which an annular floating seal assembly 112 is sealingly disposed for relative axial movement. The floating seal assembly 112 defines an axial biasing chamber 114 in the annular recess 110. The axial biasing chamber 114 is in communication with one of the series of moving compression pockets 104 at an intermediate pressure via a passageway (not shown). Intermediate-pressure working fluid within the axial biasing chamber 114 may axially bias the non-orbiting scroll member 84 towards the orbiting scroll member 82.

The discharge chamber 38 may be formed by the transversely extending partition 30 and the end cap 28. The end cap 28 has at least one discharge opening 48 through the shell assembly 12 to the discharge chamber 38. A discharge fitting 50 is coupled to the shell assembly 12 at the discharge opening 48. Compressed working fluid may move from within the discharge chamber 38 to outside of the shell assembly 12 through the discharge fitting 50 extending through the discharge opening 48.

A discharge line 51, as seen in FIGS. 3-7, may be in communication with one or more discharge openings 48. For example, a discharge line 51 is coupled to the discharge fitting 50 that is extending through the discharge opening 48. The discharge line 51 may connect a first compressor 10*a* to a second compressor 10*b* and the second compressor 10*b* to a third compressor 10*c*. The discharge line may contain the compressed working fluids of multiple compressors 10*a*, 10*b*, and 10*c*. Plugs 116 may be used to seal the discharge fittings 50 not in use, i.e. discharge fittings 50 not in communication with the discharge line 51. For example, the plugs 116 may threadably engage the discharge fitting 50. Though a single discharge line 51 is represented, it is envisioned that there may be more than one discharge line 51 attached to one or more of the multiple of compressors 10.

The suction chamber 40 may be disposed adjacent the interior wall of the shell assembly 12 between the transversely extending partition 30 and the base 32. The shell assembly 12 has at least two suction openings 118 to the suction chamber 40. A suction fitting 120 is coupled to each suction opening 118. Working fluids may move from outside of the shell assembly 12 to within the shell assembly 12 through the suction fittings 120 extending through the suction openings 118. Specifically, working fluids may move from outside of the shell assembly 12 to within the suction chambers 40 through the suction fittings 120.

A first distributor 122*a* may be in communication with one or more suction openings 118 of a first compressor 10*a* and one or more suction openings 118 of a second compressor 10*b*. The first distributor 122*a* is in communication with suction fittings 120 extending through the respective suction openings 118. The first distributor 122*a* may be coupled to a plurality of suction tubes 143*a*, 143*b*. One of the plurality of suction tubes 143*a* may be coupled to at least one suction fitting 120 of the first compressor 10*a* and another one of the plurality of suction tubes 143*b* may be coupled to at least one suction fitting 120 of the second compressor 10*b*.

The first distributor 122*a*, as shown in FIGS. 3-6, may be used to connect the first compressor 10*a* to the second compressor 10*b*. Similarly, a second distributor 122*b* may be used to connect the second compressor 10*b* to a third compressor 10*c*. The suction line may be coupled to each distributor 122*a*, 122*b* and may carry working fluids to each compressor 10*a*, 10*b*, and 10*c* of the system of multiple compressors. Plugs 116 may be used to seal the suction fittings 120 not in use, i.e. suction fittings 120 not in communication with the suction line 124. For example, the plugs 116 may threadably engage the suction fittings 120.

The oil sump 52 is located within the shell assembly 12 above the base 32. The oil sump 52 may be the bottom of the volume comprising the suction chamber 40. The shell assembly 12 has at least one oil opening 126 to the oil sump 52. An oil fitting 128 is coupled to each oil openings 126. An oil equalization line 130 may be coupled to one or more oil fittings 128. The oil equalization line 130 may be a short, straight line from one compressor 10*a*, 10*b*, 10*c* to another compressor 10*a*, 10*b*, 10*c*, as seen in FIGS. 3-6.

A first oil equalization line 130*a* may be in communication with at least one of the oil openings 126 of the first compressor 10*a* and at least one of the oil openings 126 of the second compressor 10*b*. The first oil equalization line 130*a* is coupled to the oil fittings 128 of the first compressor 10*a* and the second compressor 10*b*, respectively.

A second oil equalization line 130*b* may be in communication with at least one of the oil openings 126 of the second compressor 10*b* and at least one of the oil openings 126 of the third compressor 10*c*. The second oil equalization line 130*b* is coupled to the oil fittings 128 of the second compressor 10*b* and the third compressor 10*c*, respectively.

Oil may move from outside of the shell assembly 12, for example, from one of the oil equalization lines 130*a*, 130*b*, to the oil sump 52 within the shell assembly 12 through one or more of the oil openings 126. For example, lubricating oil may enter the shell assembly 12 through one of the oil fittings 128 extending through one of the oil openings 126. Under certain circumstances, oil may move from within the oil sump 52 to outside of the shell assembly 12, for example, to one of the oil equalization lines 130*a*, 130*b*, through the oil fittings 128 extending through the oil opening 126. For example, excess oil from a first compressor's 10*a* oil sump 52 may move through the oil equalization line 130 to a second compressor's 10*b* oil sump 52, which has a low oil level.

For example only, an oil path in the compressor 10 may begin at the oil sump 52. From the oil sump 52, oil may be drawn through the oil-pumping concentric bore 78 and the smaller diameter bore 80 in the drive shaft 68 to lubricate the plurality of bearings 56 and the journal bearing 96 as well as the interfaces between the non-orbiting scroll member 84 and the orbiting scroll member 82. Upon lubricating the plurality of bearings 56, the journal bearing 96, the interfaces between the non-orbiting scroll member 84 and the orbiting scroll member 82, and additional surfaces some of the oil may become entrained in the compressed gases and may exit the compressor 10 through the discharge opening 48 into the discharge line 51, while the remaining oil returns back down to the oil sump 52. A centrifugal force pumps the oil through the oil-pumping concentric bore 78 and the smaller diameter bore 80 of the drive shaft 68, through one of three openings: a top shaft oil opening 134, a main bearing oil opening 136, and potentially a lower bearing oil opening (not shown).

Plugs 116 may be used to seal the oil fittings 128 that are not in use, i.e. the oil fittings 128 not in communication with the oil equalization line 130. For example, the plugs 116 may threadably engage the oil fittings 128. Alternatively, any unused oil fitting 128 may be sealed with a sight glass plug 132 (i.e., a plug including a sight glass; shown schematically in FIGS. 4A, 4B, and 5A), through which the level of oil can be seen and measured.

The plugs 116 used to seal the unused oil fittings 128, suction fittings 120, and discharge fittings 50 in the various embodiments do not need to be uniformed or consistent. For example, the plugs used to seal oil fittings 128 not coupled to an oil equalization line 130, suction fittings 120 not coupled to one of the suction tubes 143*a*, 143*b* or in communication with one of the distributors 122*a*, 122*b*, and discharge fittings 50 not coupled to discharge lines 51 do no need to be identical. Different plug-types may be used to seal different openings and fittings. For instance, the plugs 116 respectively sealing the unused fittings may differ in size, shape, and attachment method.

Figure 3:
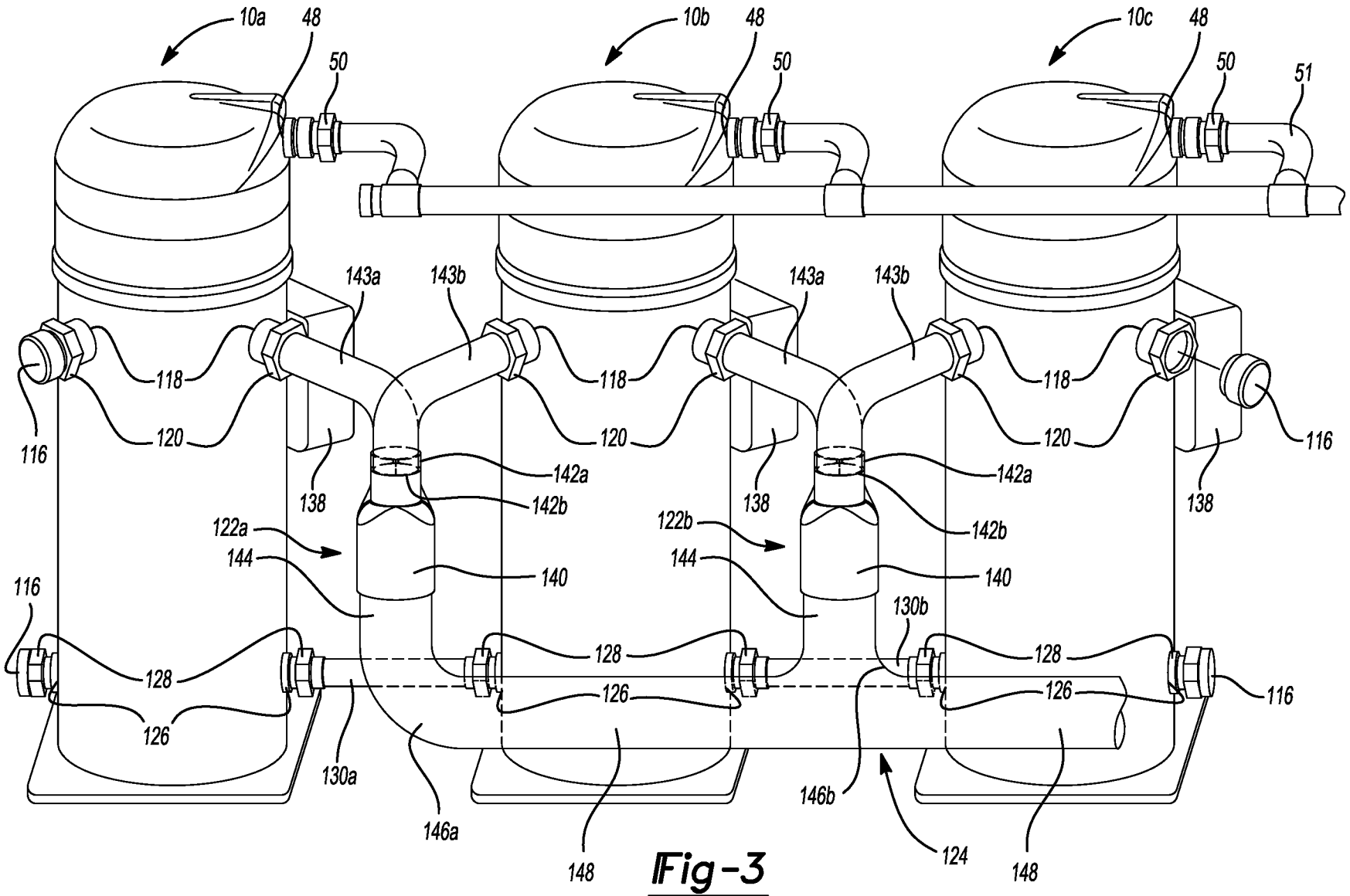
FIG. 3 is a perspective view of a system of multiple compressors including a suction line having a sweeping or sloped curvature in accordance with the principles of the present teachings.

With reference to FIG. 3, a multiple compressor system is shown that may include three of the compressors 10. The three compressors 10 may all receive suction-pressure working fluid from a common suction line 124. Each of the three compressors 10 may be fluidly coupled with the suction line 124 by one or more distributors 122*a*, 122*b*. This exemplary system of multiple compressors includes three identical compressors 10, a first compressor 10*a*, a second compressor 10*b*, and a third compressor 10*c*. However, the teachings of the present disclosure may be applied to multiple compressor systems having two or more compressors 10 and multiple compressor systems including compressors that may or may not be identical in size and displacement.

One or all of the first, second, and third compressors 10*a*, 10*b*, and 10*c* could be, for example, scroll compressors as shown and described in reference to FIGS. 1 and 2, or any other types of compressors such as reciprocating or rotary vane compressors. One or all of the first, second, and third compressors 10*a*, 10*b*, and 10*c* could be, for example, low side compressors as shown and described in FIGS. 1 and 2. Alternatively, one or all of the first, second, and third compressors 10*a*, 10*b*, and 10*c* could be, for example, high-side compressors.

The first, second, and third compressors 10*a*, 10*b*, and 10*c* could be of the same or different sizes and/or capacities. One or all first, second, and third compressors 10*a*, 10*b*, and 10*c* may be a variable-capacity compressor operable in a full capacity mode and a reduced capacity mode. In some embodiments, any number of the three compressors 10*a*, 10*b*, and 10*c* could be a digitally modulated scroll compressor, for example, that is operable to selectively separate its orbiting and non-orbiting scrolls to allow partially compressed working fluid to leak out of compression pockets formed by the scrolls, thereby reducing an operating capacity of any of the three compressor 10*a*, 10*b*, 10*c*. In some embodiments, any of the three compressors 10*a*, 10*b*, and 10*c* could include additional or alternative capacity modulation capabilities (e.g., variable speed motor, vapor injection, blocked suction, etc.).

The compressors 10*a*, 10*b*, and 10*c* of the exemplary system are similarly orientated, so the terminal boxes 138, mounted to the shell assemblies 12 of each compressor 10*a*, 10*b*, and 10*c*, are easily accessible when installing or servicing the multiple compressor system. For instance, the compressors 10*a*, 10*b*, and 10*c* are aligned so the terminal boxes 138 face a similar side at a similar angle. The terminal box 138 comprises the electric control components of each respective compressor 10*a*, 10*b*, and 10*c*. The discharge openings 48, the suction openings 118, and the oil openings 126 may also be similarly orientated to facilitate terminal box 138 access. Furthermore, the discharge openings 48, the suction openings 118, and the oil openings 126 may be orientated to minimize the lengths of the connecting tubing and to reduce total space required for the multiple compressor system.

The exemplary compressors 10*a*, 10*b*, and 10*c* each have one discharge opening 48, two suction openings 118, and two oil openings 126. Having at least two suction openings 118 reduces the amount of tubing needed for the suction line 124 and the oil equalization lines 130*a*, 130*b*. The additional suction openings 118 may also eliminate the need to have right-hand and left-hand compressors. The benefits are especially noticeable in the instance of the suction line 124, which generally comprises a large amount of copper. The exemplary compressors 10*a*, 10*b*, and 10*c* could be further adapted to include additional discharge openings 48, suction openings 118, and/or oil openings 126.

The first compressor 10*a* and the second compressor 10*b* may be coupled to the discharge line 51, a suction tube 143*a*, 143*b*, and a first oil equalization line 130*a*.

The discharge line 51 is in communication with the respective discharge openings 48 of the first compressor 10*a* and the second compressor 10*b*. The discharge line 51 is coupled to the respective discharge fittings 50, extending through the respective discharge openings 48, of the first compressor 10*a* and the second compressor 10*b*.

The inlet path 140 of the first distributor 122*a* may be coupled to the suction line 124. The outlet paths 142*a* and 142*b* of the first distributor 122*a* may be coupled to respective suction tubes 143*a* and 143*b*. The respective suction tubes 143*a* and 143*b* are in communication with the respective suction openings 118 of the first compressor 10*a* and the second compressor 10*b*. The respective suction tubes 143*a* and 143*b* are coupled to the respective suction fittings 120, which extend through the respective suction openings 118, of the first compressor 10*a* and the second compressor 10*b*.

The first oil equalization line 130*a* is in communication with the respective oil openings 126 of the first compressor 10*a* and the second compressor 10*b*. The first oil equalization line 130*a* is coupled to the respective oil fittings 128, which extend through the respective oil openings 126 of the first compressor 10*a* and the second compressor 10*b*.

Similarly, the second compressor 10*b* and the third compressor 10*c* may be coupled to the discharge line 51, a suction tube 143*a*, 143*b*, and a second oil equalization line 130*b*.

The discharge line 51 is in communication with the respective discharge openings 48 of the second compressor 10*b* and the third compressor 10*c*. The discharge line 51 is coupled to the respective discharge fittings 50, which extend through the respective discharge openings 48 of the second compressor 10*b* and the third compressor 10*c*.

The inlet path 140 of the second distributor 122*b* may be coupled to the suction line 124. The first and second outlet paths 142*a* and 142*b* of the second distributor 122*b* may be coupled to the respective suction tubes 143*a* and 143*b*. The respective suction tubes 143*a* and 143*b* are in communication with the respective suction openings 118 of the second compressor 10*b* and the third compressor 10*c*. The respective suction tubes 143*a* and 143*b* are coupled to the respective suction fittings 120, which extend through the respective suction openings 118 of the second compressor 10*b* and the third compressor 10*c*.

The second oil equalization line 130*b* is in communication with the respective oil openings 126 of the second compressor 10*b* and the third compressor 10*c*. The second oil equalization line 130*b* is coupled to the respective oil fittings 128, which extend through the respective oil openings 126 of the second compressor 10*b* and the third compressor 10*c*.

The distributors 122*a*, 122*b* may be manifolds each having a single inlet path 140 and two outlet paths 142*a* and 142*b*. The outlet paths, 142*a* and 142*b*, may or may not be symmetrical. For example only, the distributor may be an industrial Y-fitting. The first outlet path 142*a* may be coupled to a first suction tube 143*a*. The second outlet path 142*b* may be coupled to a second suction tube 143*b*. The first suction tube 143*a* and the second suction tube 143*b* may or may not be symmetrical.

The first suction tube 143*a* coupled to a first distributor 122*a* may be coupled to one of the suction fittings 120 of the first compressor 10*a*. The second suction tube 143*b* coupled to the first distributor 122*a* may be coupled to one of the suction fittings 120 of the second compressor 10*b*. Similarly, the first suction tube 143*a* coupled to a second distributor 122*b* may be coupled to one of the suction fittings 120 of the second compressor 10*b*. The second suction tube 143*b* coupled to the second distributor 122*b* may be coupled to one of the suction fittings 120 of the third compressor 10*c*. The unused suction fittings 120 may be sealed with plugs 116, i.e., the suction fittings 120 not coupled to a first suction tubing 143*a* or a second suction tubing 143*b* are sealed.

The single inlet paths 140 of the distributors 122*a* and 122*b* may be coupled to the suction line 124. The suction line 124 may be comprised of a first linear portion 144 and a second linear portion 148 coupled to the first linear portion 144 by curved third portions 146. The first linear portion 144 may be coupled to the single inlet paths 140 of the distributors 122*a* and 122*b*.

Figure 4A:
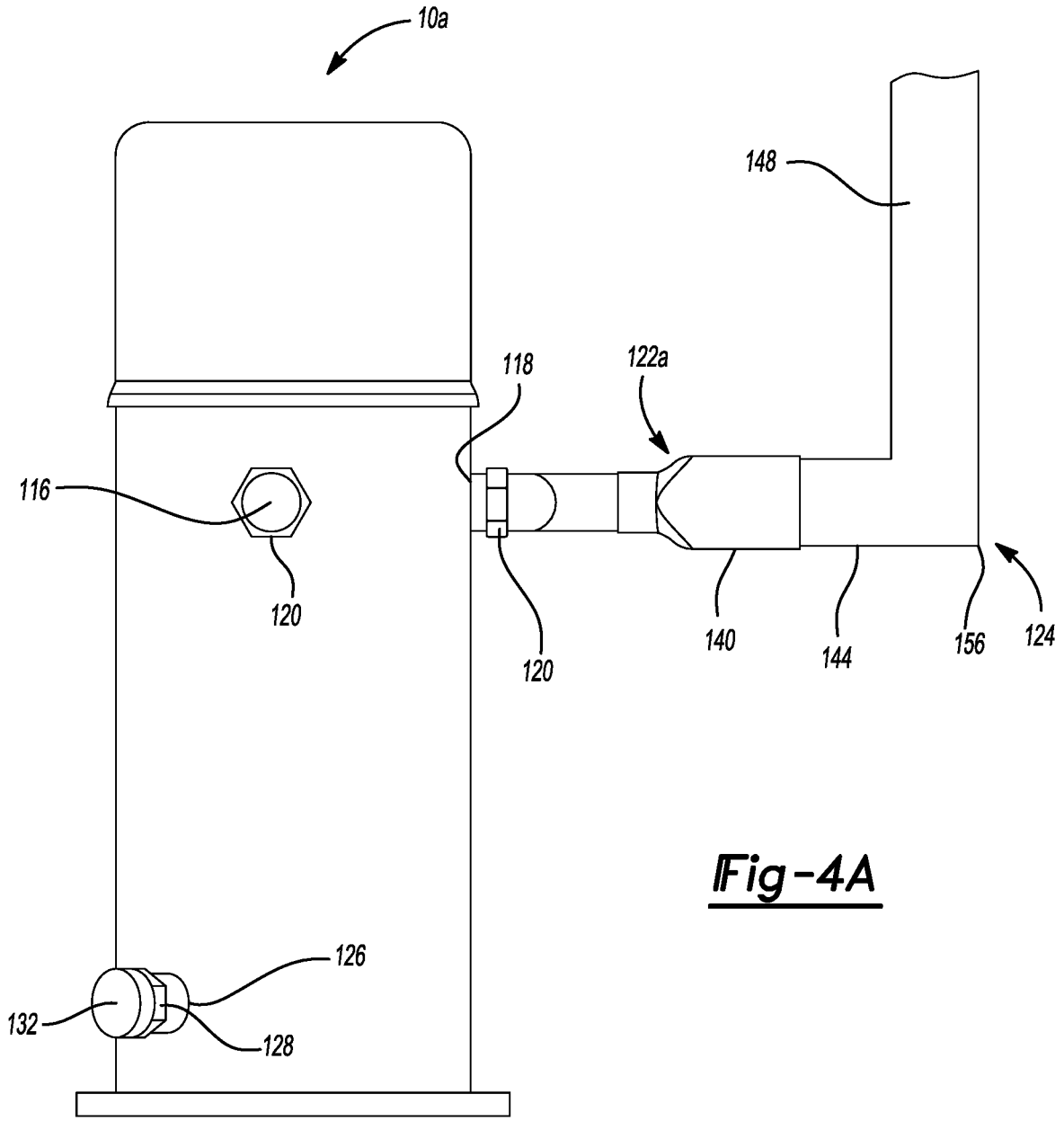
FIG. 4A is a side view of a system of multiple compressors including a suction line having a sharp right (e.g., ninety degree) angle in accordance with the principles of the present teachings.
Figure 4B:
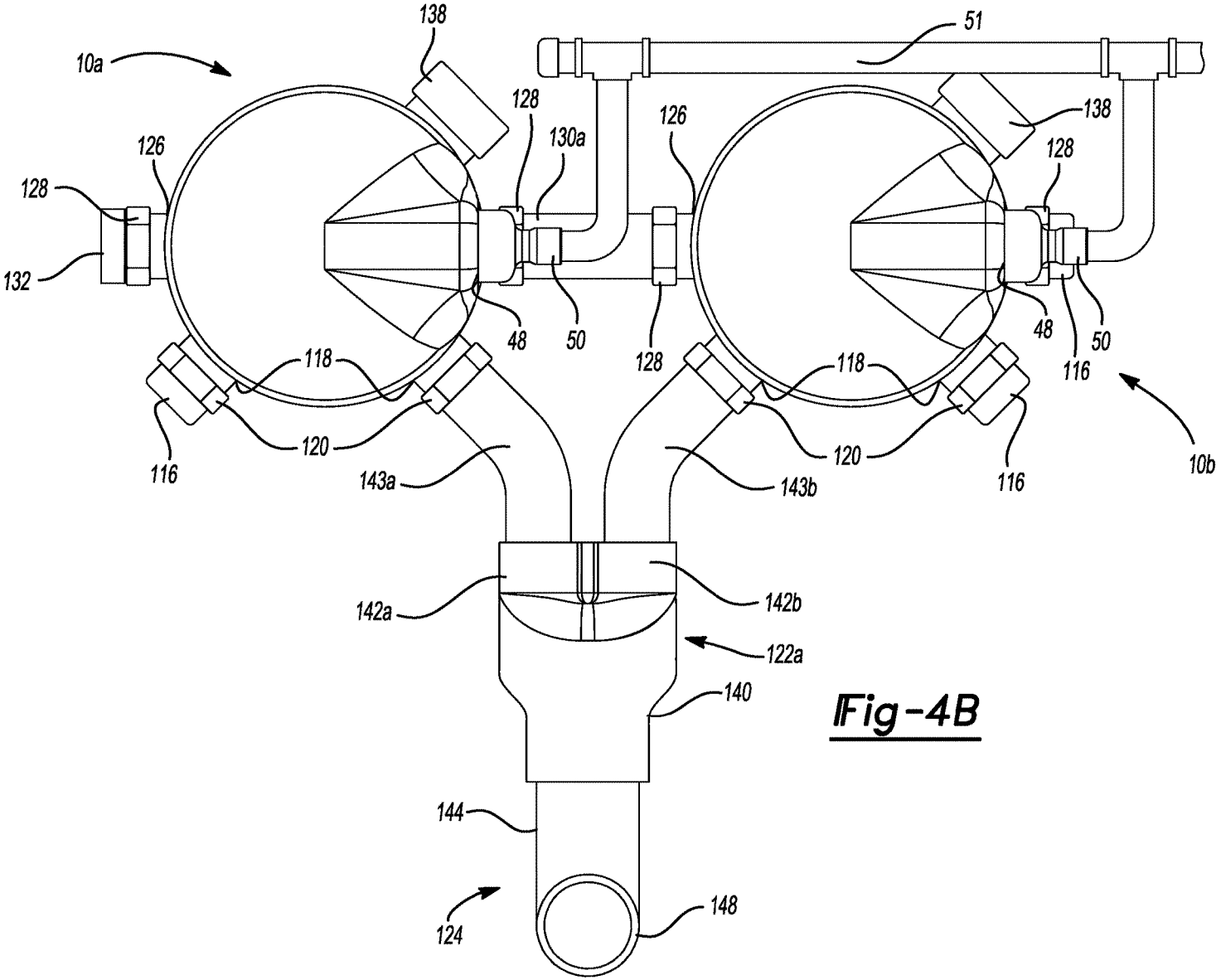
FIG. 4B is a top view of the system of FIG. 4A.
Figure 5A:
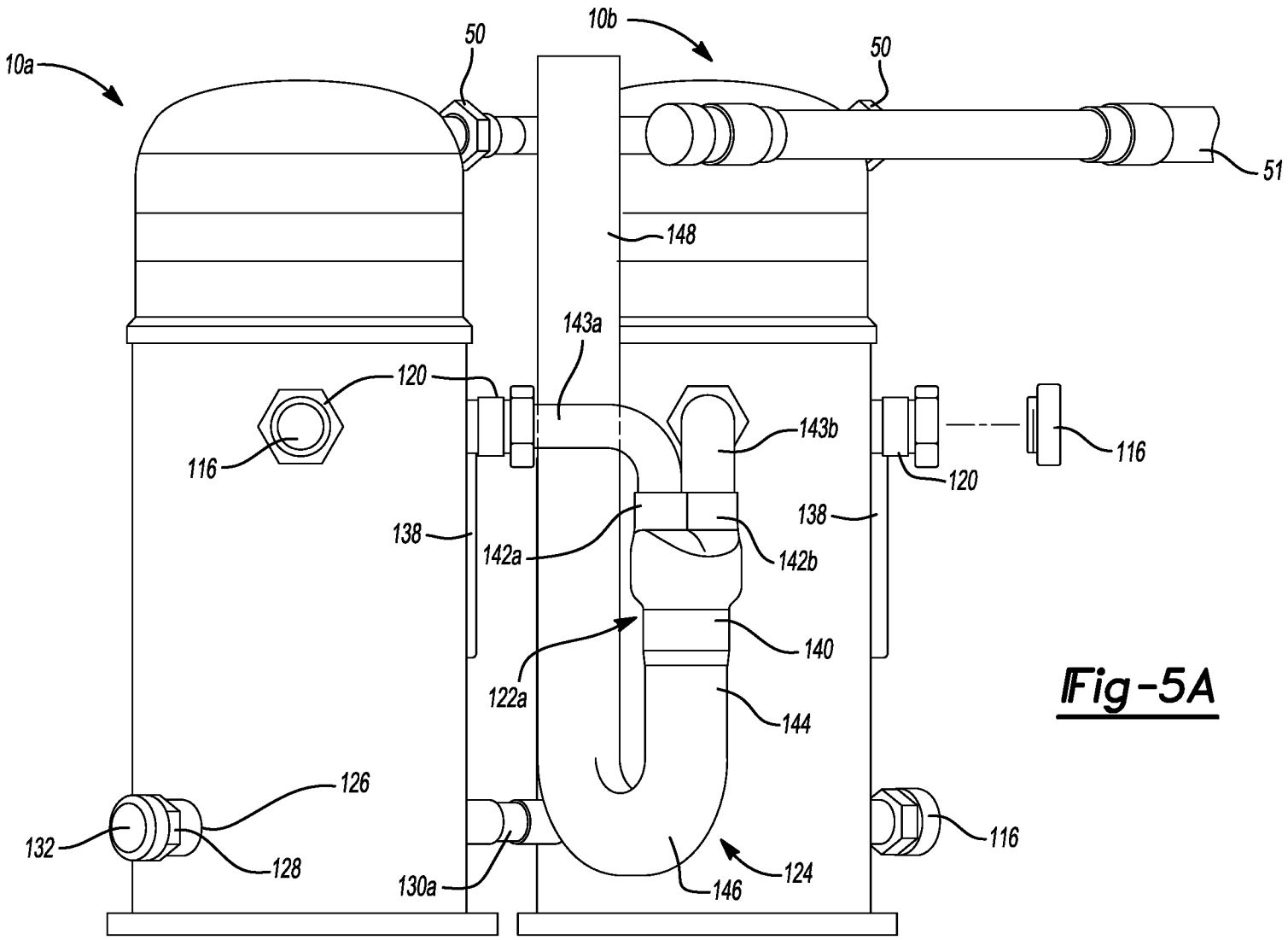
FIG. 5A is a perspective view of a system of multiple compressors including a suction line having a J-shape or hook-type curvature in accordance with the principles of the present teachings.
Figure 5B:
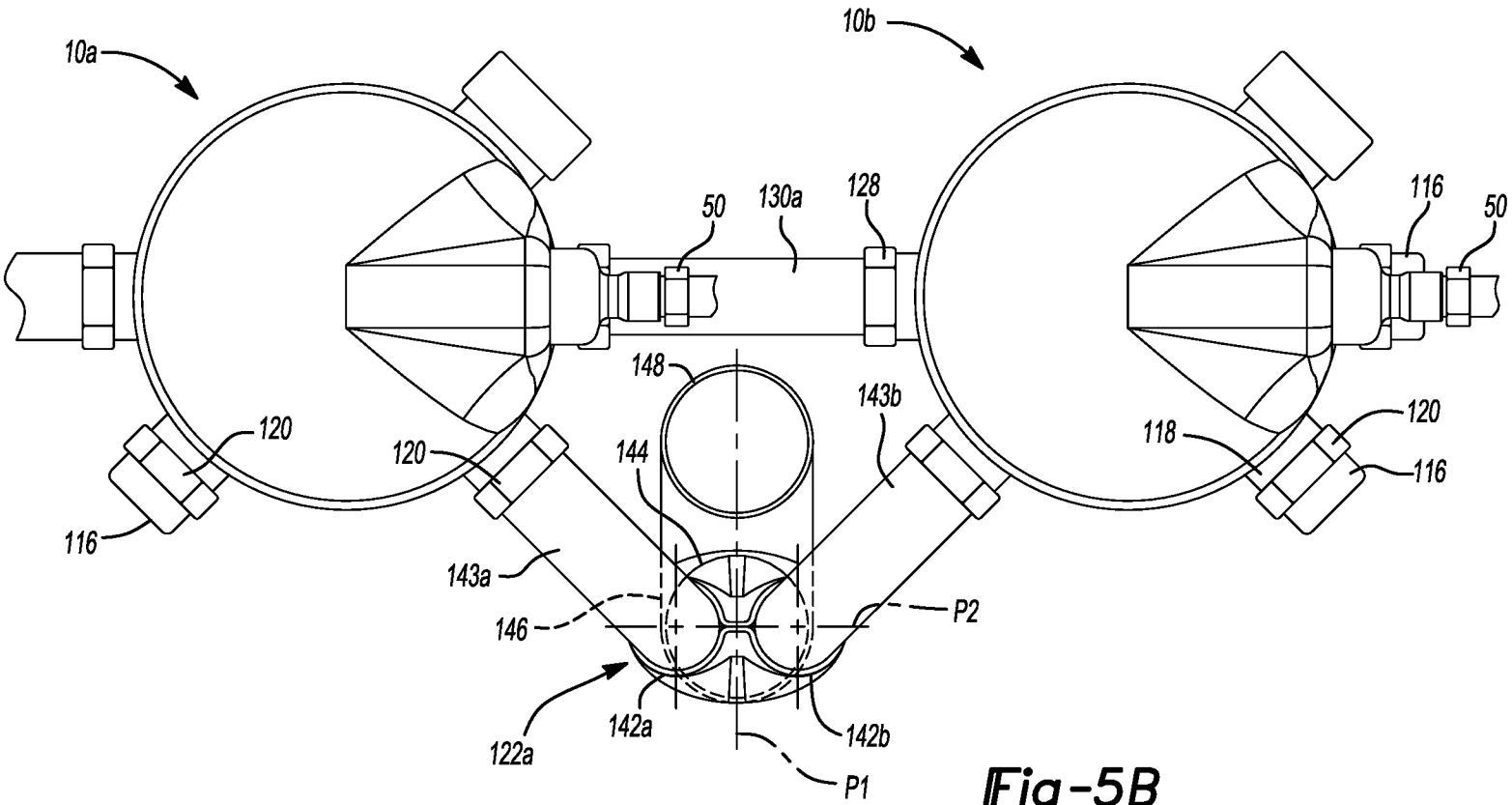
FIG. 5B is a top-down view of the system of FIG. 5A.
Figure 5C:
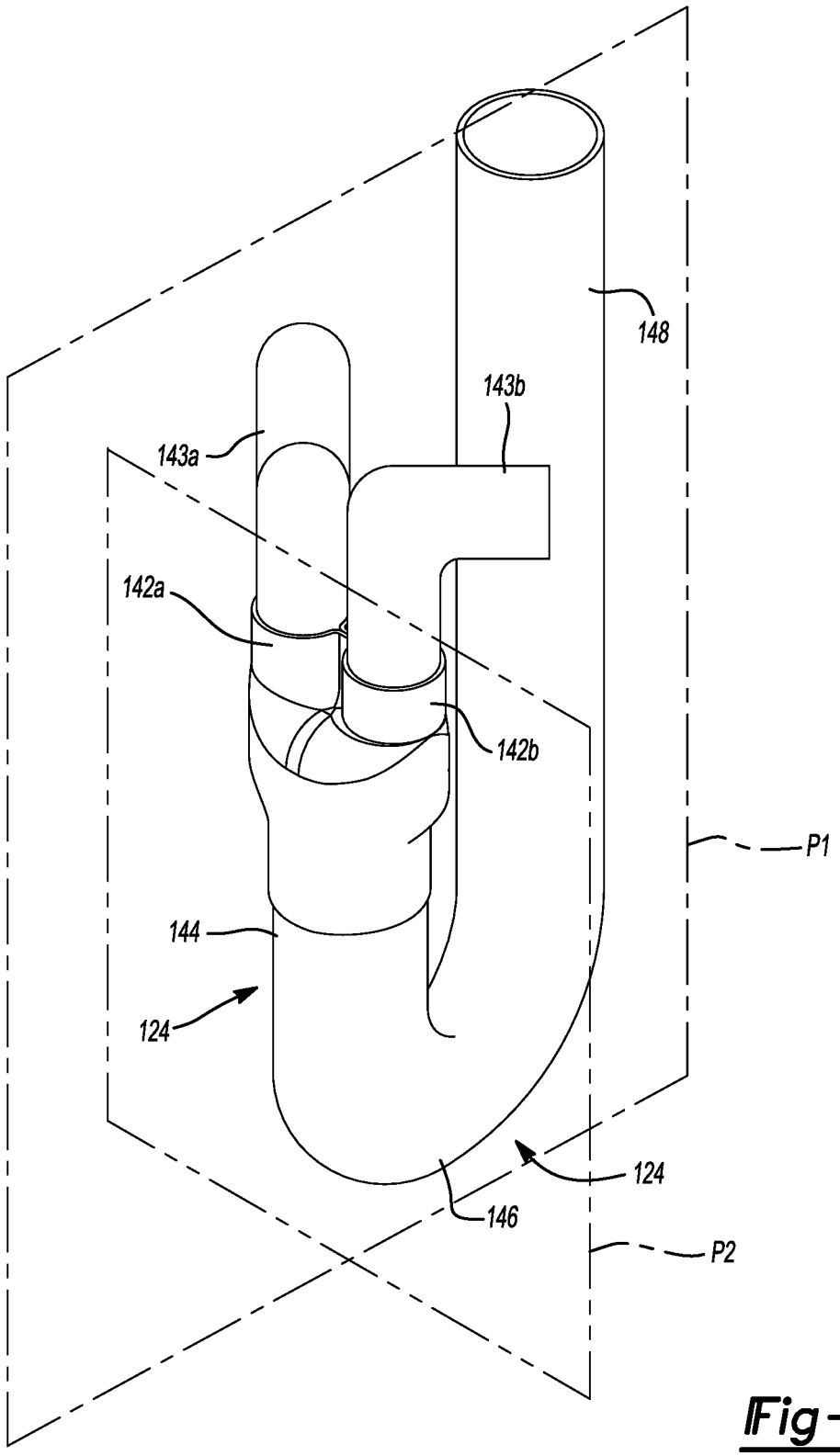
FIG. 5C is a perspective view of the suction tubes, distributors, and suction line of the system of FIG. 5A.
Figure 6:
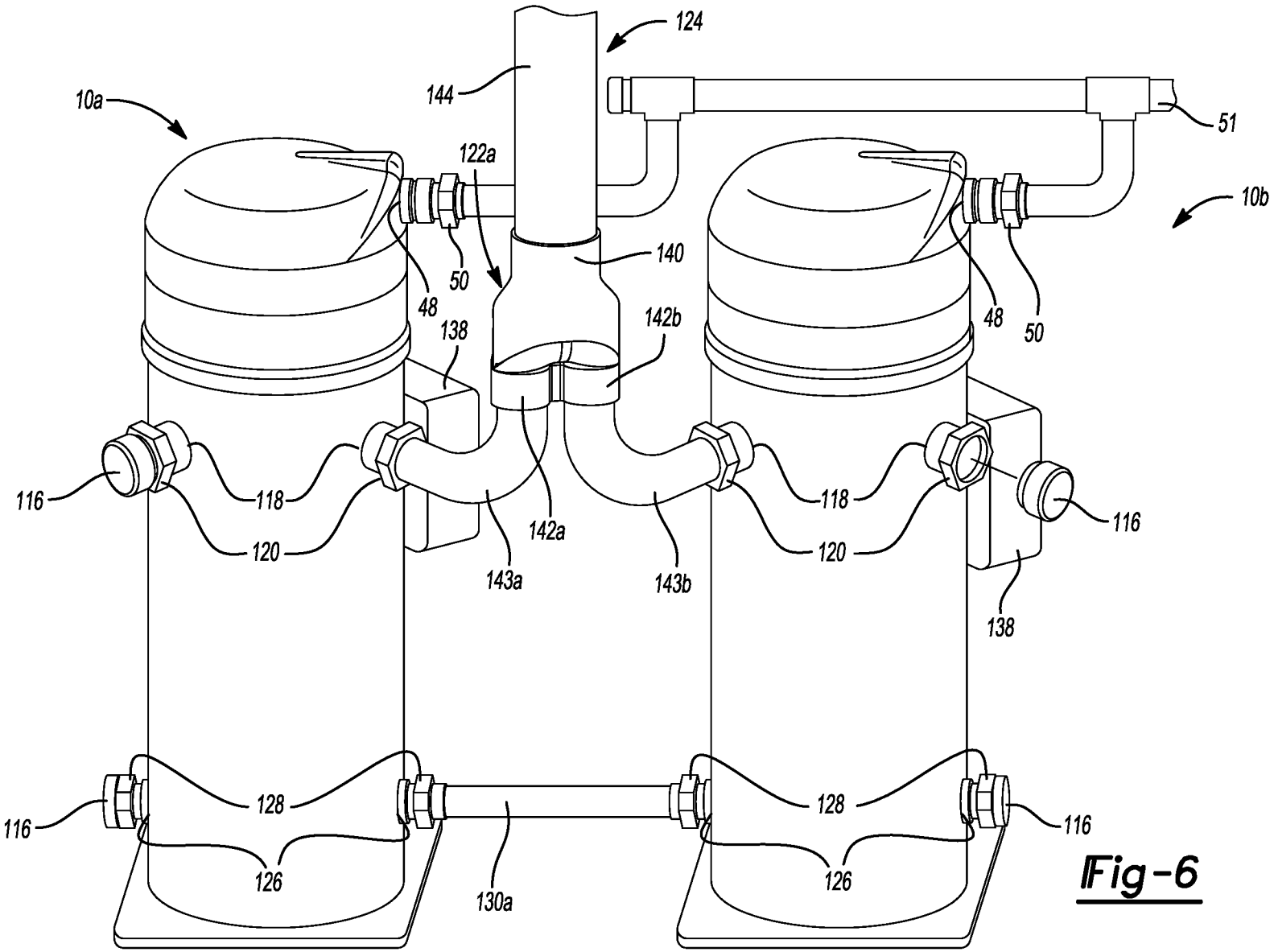
FIG. 6 is a perspective view a system of multiple compressors including a straight suction line in accordance with the principles of the present teachings.

The curvature of the curved third portions 146 may be variable. For instance, as depicted in FIG. 3, the curved third portions 146 may have a sweeping or sloped curvature. For example only, the sweeping or sloped curved third portion may be an elbow-type suction line. Alternatively, as depicted in FIGS. 4A and 4B, the suction line 124 may not include a curved third portion 146 and may instead have a sharp right (ninety degree) angle 156 (i.e., the suction line 124 may have a first linear portion 144 connected to a second linear portion 148 at a sharp right angle 156). Alternatively still, as depicted in FIGS. 5A-5C, the curved third portion 146 may have a J-shaped or hook-type curvature that curves at appropriately 180°. Alternatively still, as depicted in FIG. 6, the suction line 124 may not have a curved third portion 146 or a second linear portion 148. Instead, the suction line 124 may comprise only a first linear portion 144.

The orientation of the suction line 124 to the respective distributors 122*a* and 122*b* effects the distribution of the working fluids to the connected compressors 10*a* and 10*b*, 10*b* and 10*c*. Proper distribution of working fluids is needed to ensure efficient and reliable operation of the multiple compressor system. Working fluids move from the suction line 124 outside of the shell assembly 12 to the suction chamber 40 within the shell assembly 12 through the distributors 122*a* and 122*b*.

As seen in FIGS. 3 and 5A-5C, the orientation of the curved third portion 146 of the suction line 124 to the outlet paths 142*a* and 142*b* of the distributor effects the distribution of the working fluids to the connected compressors 10*a* and 10*b*, 10*b* and 10*c*. Similarly, as seen in FIGS. 4A and 4B, the orientation of the sharp right angle 156 of the suction line 124 to the outlet paths 142*a* and 142*b* of the distributor effects the distribution of the working fluids to the connected compressors 10*a* and 10*b*, 10*b* and 10*c*. The respective curved third portion 146 and the sharp right angle 156 are orientated to facilitate equal distribution of the incoming working fluids regardless of whether the flow of the working fluid moving through the suction line 124 is even.

For example, if the working fluids enter the distributor 122*a*, 122*b* from a suction line 124 having a curved third portion 146 with a 45°, 90°, or 180° angle, the suction line 124 may be orientated perpendicularly to the two outlet paths 142*a* and 142*b* of the respective distributor 122*a*, 122*b*. The perpendicular orientation of the suction line 124, specifically of the curved third portion 146 or the sharp right angle 156, facilitates equal distribution of working fluid to the respective compressors 10*a* and 10*b* even though working fluids may not be equally dispersed throughout the suction line 124. The perpendicular orientation of the suction line 124 allows various lengths of suction lines 124 to be used.

In FIG. 3, the curved third portions 146*a* and 146*b* each have the sweeping or sloped curvature. The curved third portion 146*a* is orthogonal to the two outlet paths 142*a* and 142*b* of the first distributor 122*a*, and the curved third portion 146*b* is orthogonal to the two outlet paths 142*a* and 142*b* of the second distributor 122*b*. For example, a first vertical plane traversing the curved third portion 146*a* is perpendicular to a second vertical plane traversing both the first and second outlet paths of 142*a* and 142*b* of the first distributor 122*a*. The first vertical plane also traverses the curved third portion 146*b* and is perpendicular to a third vertical plane traversing both the first and second outlet paths of 142*a* and 142*b* of the second distributor 122*b*.

In both instances, the first vertical plane bisects the curved third portions 146*a* and 146*b* such that the first vertical plane extends through the centers of opposite ends of the curved third portions 146*a* and 146*b*. Further, the first vertical plane may also bisect the first and second linear portions 144, 148 or at least portions of the first and second linear portions 144, 148 that are immediately adjacent to the opposite ends of the curved third portions 146*a* and 146*b*. The second vertical plane may bisect the two outlet paths 142*a* and 142*b* of the first distributor 122*a* such that cross-sectional center points of the outlet paths 142*a* and 142*b* and longitudinal axes of the outlet paths 142*a* and 142*b* are located on the second vertical plane. Similarly, the third vertical plane may bisect the two outlet paths 142*a* and 142*b* of the second distributor 122*b* such that cross-sectional center points of the outlet paths 142*a* and 142*b* and longitudinal axes of the outlet paths 142*a* and 142*b* are located on the second vertical plane.

The first vertical plane is perpendicular to the second vertical plane and the third vertical plane such that the curved third portions 146*a* and 146*b* are orthogonal to the two outlet paths 142*a* and 142*b* of the first distributor 122*a* and second distributor 122*b*, respectively. The orthogonal orientation of the curved third portions 146*a* and 146*b* relative to the outlet paths 142*a*, 142*b* of the first and second distributors 122*a* and 122*b* facilitates equal distribution of the incoming working fluids to the respective compressors 10*a* and 10*b*, and 10*b* and 10*c* even though working fluids may not be equally dispersed throughout the suction line 124 and regardless of the length of the suction line 124.

In FIGS. 4A and 4B, the suction line 124 does not have a curved third portion 146, instead the suction line 124 has a first linear portion 144 and a second linear portion 148 connected at a sharp right angle 156. The sharp right angle 156, as seen in FIG. 4B, is orthogonal to the two outlet paths of 142*a* and 142*b* of the first distributor 122*a*. For example, as shown in FIG. 4A, a first vertical plane traversing the sharp right angle 156 and the second linear portion 148 is perpendicular to a first horizontal plane traversing the first and second outlet paths of 142*a* and 142*b* of the first distributor 122*a* and the first linear portion 144.

The first vertical plane bisects the second linear portion 148 such that the first vertical plane extends through the centers of opposite ends of the second linear portion 148. The first horizontal plane bisects the two outlet paths 142*a* and 142*b* such that cross-sectional center points of the outlet paths 142*a*, 142*b* and longitudinal axes of the outlet paths 142*a* and 142*b* are located on the first horizontal plane. The first horizontal plane may also bisect the first linear portion 144 or at least a portion of the first linear portion 144 that is immediately adjacent to the inlet path 140 of the first distributor 122*a*.

The first horizontal plane is perpendicular to the first vertical plane such that the sharp right angle 156 is orthogonal to the two outlet paths 142*a* and 142*b* of the first distributor 122*a*. The orthogonal orientation of the sharp right angle 156 relative to the outlet paths 142*a* and 142*b* facilitates equal distribution of the incoming working fluids to the respective compressors 10*a* and 10*b* even though working fluids may not be equally dispersed throughout the suction line 124 and regardless of the length of the suction line 124.

In FIGS. 5A-5C, the curved third portion 146 has a J-shaped or hook-type curvature that curves at approximately 180°. The curved third portion 146 is orthogonal to the two outlet paths 142*a* and 142*b* of the distributor 122*a*. For example, a first vertical plane P1 (FIGS. 5B and 5C) traversing the curved third portion 146 and the second linear portion 148 is perpendicular to a second vertical plane P2 (FIGS. 5B and 5C) traversing both the first and second outlet paths of 142*a* and 142*b* of the first distributor 122*a*.

As shown in FIGS. 5B and 5C, the first vertical plane P1 bisects the curved third portion 146 such that the first vertical plane P1 extends through the centers of opposite ends of the curved third portion 146. Further, the first vertical plane P1 may also bisect the first and second linear portions 144, 148 or at least portions of the first and second linear portions 144, 148 that are immediately adjacent to the opposite ends of the curved third portion 146. The second vertical plane P2 may bisect the two outlet paths 142*a* and 142*b* such that cross-sectional center points of the outlet paths 142*a*, 142*b* and longitudinal axes of the outlet paths 142*a* and 142*b* are located on the second vertical plane P2.

As shown in FIGS. 5B and 5C, the planes P1, P2 are perpendicular to each other such that curved third portion 146 is orthogonal to the two outlet paths 142*a* and 142*b* of the distributor 122*a*. The orthogonal orientation of the curved third portion 146 relative to the outlet paths 142*a* and 142*b* facilitates equal distribution of the incoming working fluids to the respective compressors 10*a* and 10*b* even though working fluids may not be equally dispersed throughout the suction line 124 and regardless of the length of the suction line 124.

Alternatively, as shown in FIG. 6, the working fluids may enter the distributors 122*a* from a suction line 124 having only a first linear portion 144. In such instances, the suction line 124 may be of a predetermined length so to allow the working fluids to obtain an even flow before entering the distributor 122*a*. The predetermined length of the straight suction line 124 is the attenuation length. The even flow of the working fluids prior to entrance into the distributors facilitates equal distribution of the incoming working fluids to the connected compressors 10*a*, 10*b*, and 10*c*. The predetermined length of the suction line 124 may be determined by multiplying the diameter of the straight suction line by an established coefficient.

If proper orientation and length is maintained as described, the respective distributors 122*a* and suction lines 124 may be placed between the compressors 10*a* and 10*b*. For example in FIGS. 5A and 5B, the curved third portion 146 is placed in between the compressors 10*a* and 10*b* reducing the total area required by the system of multiple compressors.

The oil equalization line 130 in a system of multiple compressors may be a short, straight line from one compressor to another compressor, as seen in FIGS. 3-6. Use of the short, straight oil equalization line 130 reduces cost and pressure drops. The oil equalization line 130 may be a small-diameter tube for transfer of lubricant oil between compressors. A small-diameter tube may have a diameter of 0.625 inch, for example. In another embodiment, the oil equalization line 130 may also have a large diameter when it is used for both lubricant oil and refrigerant gas. A large-diameter tube may have a diameter of 1.375 inches, for example. The oil equalization line 130 may include a solenoid valve or flow ball valve (not shown) that may be controlled by an external processor, variable speed drive, or system controller.

Similar concepts as described in regards to the suction line 124 may be applied to the oil equalization lines 130 and to the discharge lines 51. Additionally, similar concepts as described in regards to the suction openings 118 may be applied to the oil openings 126 and to the discharge openings 48. For example, the multiple compressor system may have compressors having multiple fittings for the discharge line 51 and the oil equalization line 130.

Figure 7:
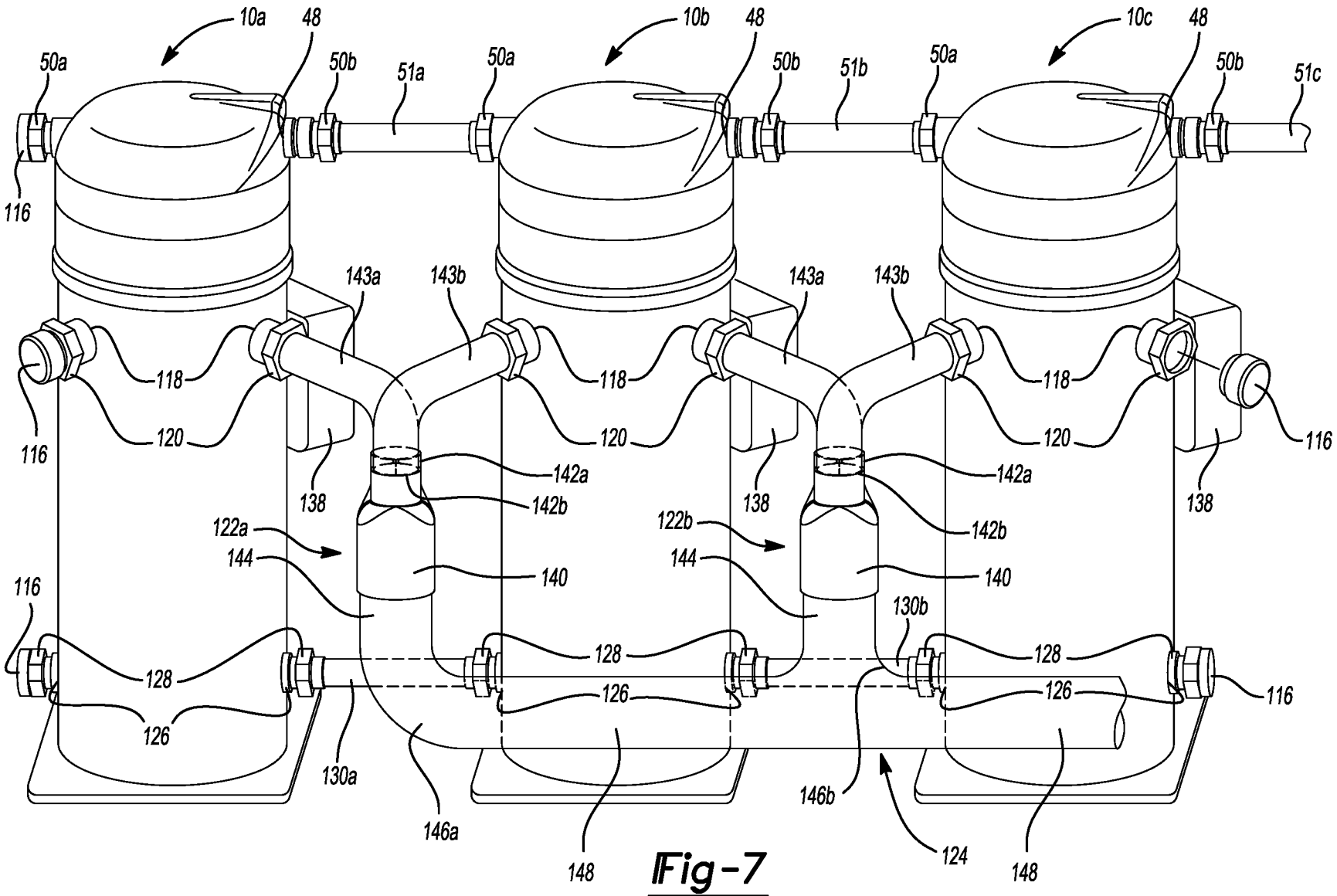
FIG. 7 is a perspective view of another system of multiple compressors in accordance with the principles of the present teachings.

FIG. 7 depicts another multiple compressor system in which each of the compressors 10*a*, 10*b*, 10*c* includes first and second discharge fittings 50*a*, 50*b* received in first and second discharge openings, respectively. The first fitting 50*a* of the compressor 10*a* may be sealed by a plug 116. The second fitting 50*b* of the compressor 10*a* may be fluidly coupled to the first fitting 50*a* of the compressor 10*b* by a discharge line 51*a*. The second fitting 50*b* of the compressor 10*b* may be fluidly coupled to the first fitting 50*a* of the compressor 10*c* by another discharge line 51*b*. The second fitting 50*b* of the compressor 10*c* may be fluidly coupled to another discharge line 51*c* that may be connected to a heat exchanger (e.g., a condenser; not shown) and/or another component of a climate-control system in which the compressors 10*a*, 10*b*, 10*c* are installed. Working fluid compressed by the compressor 10*a* may flow from the discharge chamber 38 of the compressor 10*a* to the discharge chamber 38 of the compressor 10*b* through the discharge line 51*a*. Working fluid compressed by both of the compressors 10*a*, 10*b* may flow from the discharge chamber 38 of the compressor 10*b* to the discharge chamber 38 of the compressor 10*c* through the discharge line 51*b*. Working fluid compressed by all of the compressors 10*a*, 10*b*, 10*c* may flow from the discharge chamber 38 of the compressor 10*c* to the discharge line 51*c* and then to the heat exchanger and/or other components of the climate-control system.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a compression mechanism;

a driveshaft drivingly coupled to the compression mechanism;

a shell assembly in which the compression mechanism is disposed, the shell assembly forming a discharge chamber and including at least one discharge opening into the discharge chamber, the shell assembly including at least two suction openings into a suction chamber disposed within the shell assembly; and a first plug sealing one of the suction openings and preventing fluid flow therethrough, wherein another one of the suction openings is open to allow fluid flow therethrough w the compressor is in operation.

2. The compressor of claim 1, wherein an oil sump is disposed within the shell assembly and the shell assembly has a plurality of oil openings into the oil sump, wherein one of the oil openings is sealed with a second plug to prevent fluid flow therethrough, and wherein another one of the oil openings is open to allow fluid flow therethrough.

3. The compressor of claim 2, wherein the second plug includes an oil sight glass.

4. The compressor of claim 3, further comprising a third plug sealing one of the discharge openings and preventing fluid flow therethrough, wherein another one of the discharge openings is open to allow fluid flow therethrough.

5. A system comprising:

a first compressor and a second compressor, each of the first and second compressors including a compression mechanism disposed within a shell assembly, each shell assembly defining a discharge chamber containing discharge-pressure working fluid discharged from the compression mechanism and a suction-pressure region containing suction-pressure working fluid, each shell assembly having a plurality of suction openings in communication with the suction-pressure region and at least one discharge opening in communication with the discharge chamber;

a suction line in communication with one of the suction openings of the first compressor and one of the suction openings of the second compressor;

a first suction plug sealing another one of the suction openings of the first compressor and preventing fluid flow therethrough; and a second suction plug sealing another one of the suction openings of the second compressor and preventing fluid flow therethrough.

6. The system of claim 5, further comprising:

a discharge line in communication with one of the discharge openings of the first compressor and one of the discharge openings of the second compressor; and a discharge plug sealing another one of the discharge openings of the first compressor and preventing fluid flow therethrough.

7. The system of claim 5, wherein each shell assembly defines an oil sump and includes a plurality of oil openings in communication with the oil sump, the system further comprising:

an oil equalization line in communication with one of the oil openings of the first compressor and one of the oil openings of the second compressor; and a first oil plug sealing another one of the oil openings of the first compressor and preventing fluid flow therethrough; and a second oil plug sealing another one of the oil openings of the second compressor and preventing fluid flow therethrough.

8. The system of claim 7, wherein one or both of the first and second oil plugs includes an oil sight glass.

9. The system of claim 5, further comprising:

a distributor including an inlet path and first and second outlet paths, wherein:

the first outlet path is coupled to a first suction tube and the second outlet path is coupled to a second suction tube, the first suction tube is in communication with one of the suction openings of the first compressor, the second suction tube is in communication with one of the suction openings of the second compressor, another one of the suction openings of the first compressor is sealed to prevent fluid flow therethrough, and another one of the suction openings of the second compressor is sealed to prevent fluid flow therethrough.

10. The system of claim 5, further comprising:

a distributor including an inlet path and first and second outlet paths, wherein the first outlet path is in communication with one of the suction openings of the first compressor and the second outlet path is in communication with one of the suction openings of the second compressor.

11. The system of claim 10, further comprising:

a suction line coupled to the inlet path of the distributor, wherein the suction line comprises a first linear portion and a second linear portion connected by a curved third portion, and the curved third portion is orientated perpendicularly to the first and second outlet paths of the distributor.

12. The system of claim 10, further comprising:

a straight suction line coupled to the inlet path of the distributor, wherein the straight suction line is a predetermined length to allow fluids to obtain even flow prior to reaching the distributor.

13. The system of claim 10, further comprising:

a discharge line in communication with one of the discharge openings of the first compressor and one of the discharge openings of the second compressor; and a discharge plug sealing another one of the discharge openings of the first compressor and preventing fluid flow therethrough.

14. The system of claim 10, wherein each shell assembly defines an oil sump and includes a plurality of oil openings in communication with the oil sump, the system further comprising:

an oil equalization line in communication with one of the oil openings of the first compressor and one of the oil openings of the second compressor; and a first oil plug sealing another one of the oil openings of the first compressor and preventing fluid flow therethrough; and a second oil plug sealing another one of the oil openings of the second compressor and preventing fluid flow therethrough.

15. The system of claim 14, wherein one or both of the first and second oil plugs includes an oil sight glass.

16. A system comprising:

a first compressor and a second compressor, each of the first and second compressors including a compression mechanism disposed within a shell assembly, each shell assembly defining a discharge chamber containing discharge-pressure working fluid discharged from the compression mechanism, each of the first and second compressors including a suction-pressure region disposed within the shell assembly and containing suction-pressure working fluid, each shell assembly having a suction opening in communication with the suction-pressure region and a discharge opening in communication with the discharge chamber;

a distributor having an inlet path and first and second outlet paths, wherein the first outlet path is in communication with the suction opening of the first compressor and the second outlet path is in communication with the suction opening of the second compressor; and a suction line coupled to the inlet path of the distributor, the suction line including a first portion and a second portion, the first portion is disposed upstream of the inlet path and downstream of the second portion, wherein a first plane bisecting the first and second portions is perpendicular to a second plane that bisects the first and second outlet paths.

17. The system of claim 16, wherein the first portion is a linear portion and the second portion is a curved portion.

18. The system of claim 16, wherein the first portion is a first linear portion that forms a ninety-degree angle with the second portion, wherein the second portion is a second linear portion.

19. The system of claim 16, wherein each shell assembly includes a plurality of suction openings in communication with the suction-pressure region, and wherein the system further comprises first and second suction plugs, the first suction plug sealing one of the suction openings of the first compressor and preventing fluid flow therethrough, the second suction plug sealing one of the suction openings of the second compressor and preventing fluid flow therethrough.

20. The system of claim 16, wherein each shell assembly includes a plurality of discharge openings in communication with the discharge chamber, the system further comprising:

a discharge line in communication with one of the discharge openings of the first compressor and one of the discharge openings of the second compressor; and a discharge plug sealing another one of the discharge openings of the first compressor and preventing fluid flow therethrough.

21. The system of claim 16, wherein each shell assembly defines an oil sump and includes a plurality of oil openings in communication with the oil sump, the system further comprising:

an oil equalization line in communication with one of the oil openings of the first compressor and one of the oil openings of the second compressor; and a first oil plug sealing another one of the oil openings of the first compressor and preventing fluid flow therethrough; and a second oil plug sealing another one of the oil openings of the second compressor and preventing fluid flow therethrough.

22. The system of claim 21, wherein one or both of the first and second oil plugs includes an oil sight glass.

* * * * *